United States Patent [19]

Gaskill et al.

[11] Patent Number: 4,922,260

[45] Date of Patent: May 1, 1990

[54] ADJUSTABLE WATCHBAND WITH EMBEDDED ANTENNA

[75] Inventors: Garold B. Gaskill, Tualatin; Michael Miles, Aloha; Clifford B. Schrock, Portland, all of Oreg.

[73] Assignee: AT & E Corporation, San Francisco, Calif.

[21] Appl. No.: 298,523

[22] Filed: Jan. 18, 1989

[51] Int. Cl.[5] ..... H05G 1/14

[52] U.S. Cl. ..... 343/718; 455/351

[58] Field of Search ..... 343/718; 455/347, 348, 455/351; 224/170, 175

[56] References Cited

U.S. PATENT DOCUMENTS 4,754,285 6/1988 Robitaille ..... 343/718

4,769,656 9/1988 Dickey ..... 343/718

*Primary Examiner*—Rolf Hille

*Assistant Examiner*—Doris J. Johnson

*Attorney, Agent, or Firm*—Salzman & Levy

[57] ABSTRACT

The present invention provides a means of maintaining a constant tuned frequency as a wrist band antenna is lengthened and shortened. As a wrist band antenna is lengthened, the inductance of the antenna is generally increased. The present invention provides a wrist band the length of the antenna. As the wrist band is lengthened the inductance increases and the capacitance decreases thereby maintaining the tuned frequency substantially constant.

12 Claims, 3 Drawing Sheets

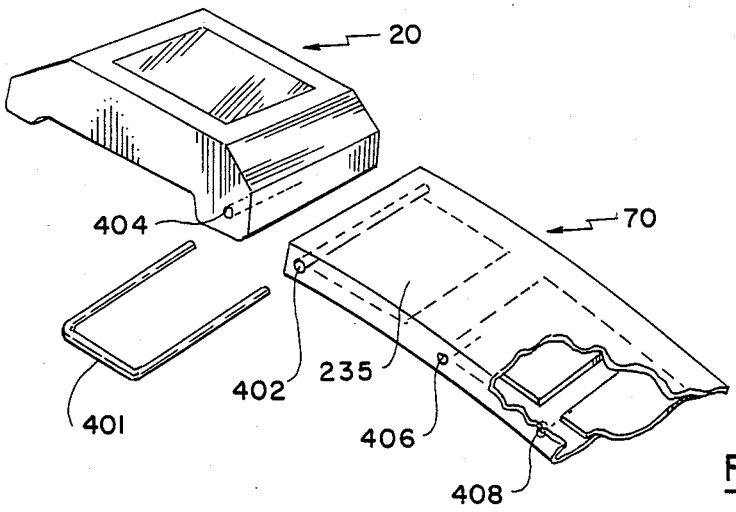
FIG. 4
FIG. 5
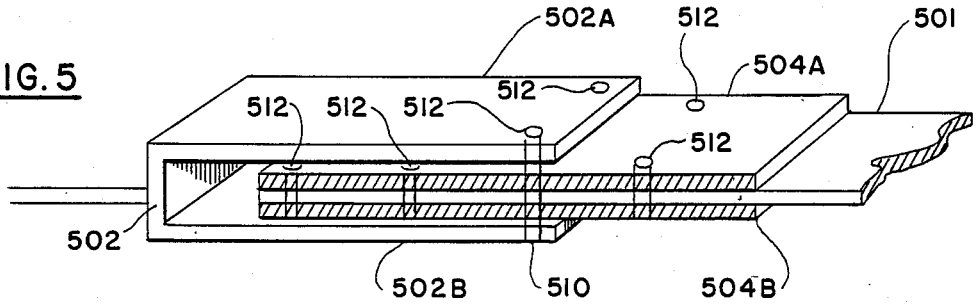
FIG. 6
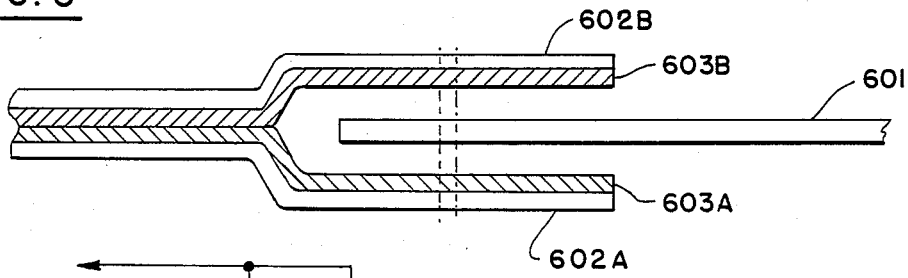
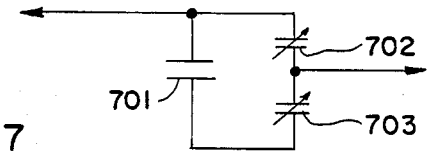
FIG. 7

ADJUSTABLE WATCHBAND WITH EMBEDDED ANTENNA

FIELD OF THE INVENTION

The present invention relates to a radio receiver and more particularly to antennas for a radio receiver located in a wristwatch.

BACKGROUND OF THE INVENTION

It is known that the antenna required for a radio receiver located in a wristwatch can be embedded in the wristwatch band which holds the watch. One such system is illustrated and described in U.S. Pat. No. 4,713,808 issued to Gaskill et al. and hereby incorporated by reference.

The small size and portable nature of the receiver place stringent demands on the receiver antenna system. For example, the number of stages of RF amplification in the receiver must be kept to a minimum to minimize the drain on its battery. Accordingly, a relatively strong signal must be provided to the receiver from the antenna; however, the small size and portable nature of the receiver dictates that its antenna be small and unobtrusive, thereby producing a relatively weak signal.

In the case of an antenna located in the wristwatch band, additional problems are presented because different users have different physical bodily proportions. One length wristwatch band that can be used by a person with a small wrist will not also be usable by a person with a large wrist. Thus, it is desirable to have a wristwatch band with an adjustable length.

The tuning frequency, f, in an LC electrical circuit, whether series or parallel, is inversely proportional to the product of circuit inductance, L, and capacitance, C, and specifically obeys the following expression:

$$f = \frac{1}{2\pi\sqrt{LC}}$$

Since the inductance of an antenna in a wrist band is proportional to length of the wire, when a wrist band and the associated antenna change in length, the tuning frequency thereof also changes. Thus, by decreasing the length of the antenna watchband for small wrists, inductance also decreases, thereby increasing the tuned frequency of the antenna.

OBJECTS AND ADVANTAGES OF THE INVENTION

It would be advantageous to provide a watchband that has an embedded antenna.

It would also be advantageous to provide an antenna watchband that would allow for physical adjustment while maintaining a constant tuning frequency for the antenna embedded therein.

It would also be advantageous to provide a watchband for use on a person's wrist in which one or more portions thereof could be removed, depending upon the physical size of the user's wrist, without affecting the tuning frequency of the antenna.

SUMMARY OF THE INVENTION

The present invention provides a means of maintaining a constant tuned frequency as a wrist band antenna is lengthened and shortened. As a wrist band antenna is lengthened, the inductance of the antenna is generally increased. The present invention provides a wrist band antenna which has a capacitance value which is a function of the length of the antenna. As the wrist band is lengthened the inductance increases and the capacitance decreases thereby maintaining the tuned frequency substantially constant.

BRIEF DESCRIPTION OF THE DRAWINGS

A complete understanding of the present invention may be obtained by reference to the accompanying drawings, when and in which:

FIG. 4 is a perspective view of another embodiment of the present invention;

FIG. 5 is a perspective view of another embodiment of the present invention;

FIG. 6 is a cross sectional view of another embodiment of the present invention;

FIG. 7 is an electrical circuit diagram of part of the wrist band shown in FIG. 2.

DESCRIPTION OF PREFERRED EMBODIMENT

Figure 1:
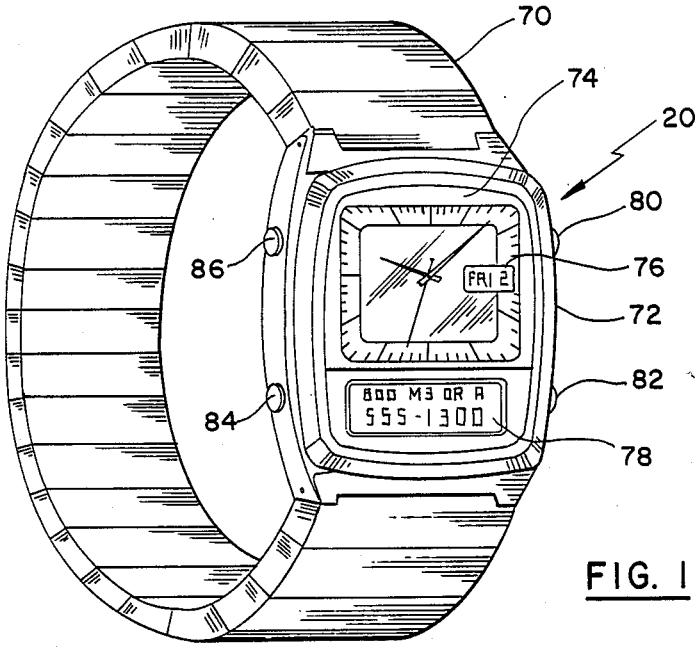
FIG. 1 is a perspective view of a wrist receiver and watchband.
Figure 8A:
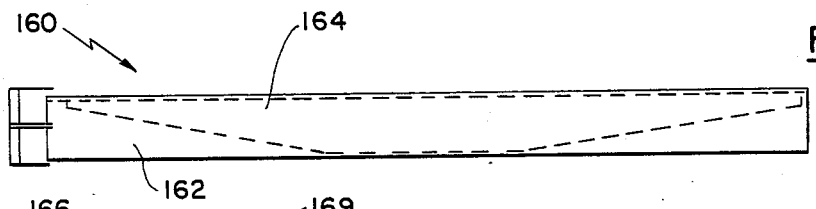
FIGS. 8*a*, 8*b*, and 8*c* are still other embodiments of the invention.
Figure 8B:
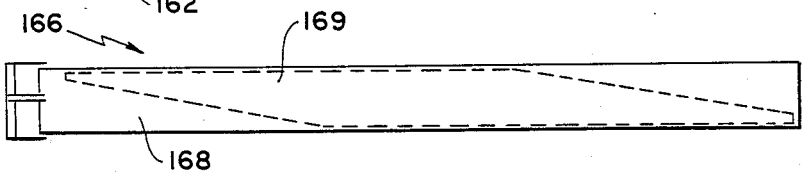
Figure 8C:
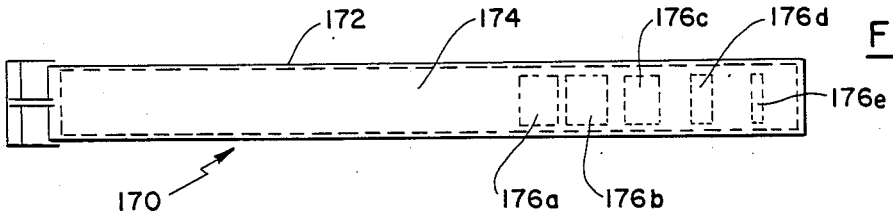

Referring now to FIG. 1, there is shown a wrist receiver and watchband in accordance with the present invention. The details of the electronics in watch 20 may be similar to those shown in U.S. Pat. No. 4,713,808 issued to Gaskill et al. or in copending patent application Ser. No. 07/121,139, filed Nov. 16, 1987.

Watch 20, used by each receiving user, is arranged much like a conventional digital wristwatch. The watch has a wrist band or watchband 70, which incorporates an antenna, described hereinafter, and an electronic clock and paging device 72. Device 72 includes internal electronic circuitry, not shown, an analog watch display face 74 and, optionally, a day-date display 76. Device 72 also includes a paging data display 78, for displaying an area code, telephone number and various message symbols.

Device 72 has four control buttons 80, 82, 84, 86, two on each side of watch face 74. The functions of these buttons can be as described in the above referenced patent and patent application.

Figure 2:
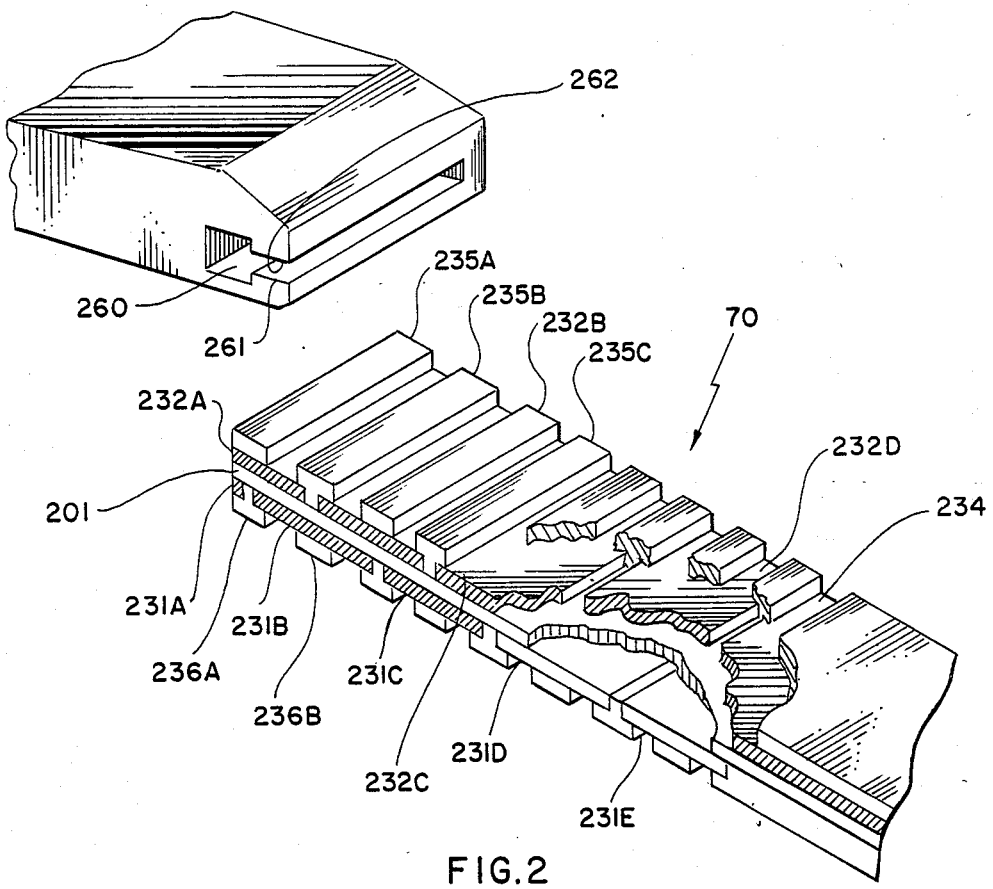
FIG. 2 is cross sectional view of a watch band connector.

FIG. 2 shows the detailed construction of one embodiment of watchband 70. The main elements of band 70 are an insulating or dielectric strip 201 which has capacitor plates 231B, 231C, 231D, . . . on the bottom thereof and corresponding capacitor plates 232A, 232B, 232C, . . . on the top thereof. Dielectric strip 201 is formed of electrically nonconductive material such as thermoplastic rubber, polyimide or other suitably flexible material while plates 231 and 232 are formed of copper in the preferred embodiment. Alternatively, beryllium copper can be substituted for the conductive plates disposed on strip 201. Portions of each plate 231 and 232 are covered by molded plastic strips 235A, 235B, 235C, . . . on the top of insulating strip 201 and molded plastic strips 236A, 236B, 236C, . . . on the bottom thereof. Plates 231 and 232 can also be plated with nickel or a palladium nickel alloy first and then gold for electrical and physical protection as well as for ornamental purposes.

Each upper surface plate 232 is disposed so as to overlap portions of the two oppositely disposed lower surface plates 23 in closest proximity and corresponding thereto. In the same manner, each of the lower surface plates 231 overlaps portions of the two oppositely disposed upper surface plates 232 in closest proximity and corresponding thereto. The overlapping configuration forms a series of capacitors, the values of which are selected to maintain a predetermined antenna tuning frequency.

Band 70 is connected to watch 20 by fitting a pair of corresponding strips 235 and 236 in slot 260. Contact strips 261 and 262 make physical and electrical contact with at least one plate 231 or 232. Top plastic strips 235 are held to bottom strips 236 by molded through lugs (not shown in the drawing) that hold the entire assembly together.

Figure 3:
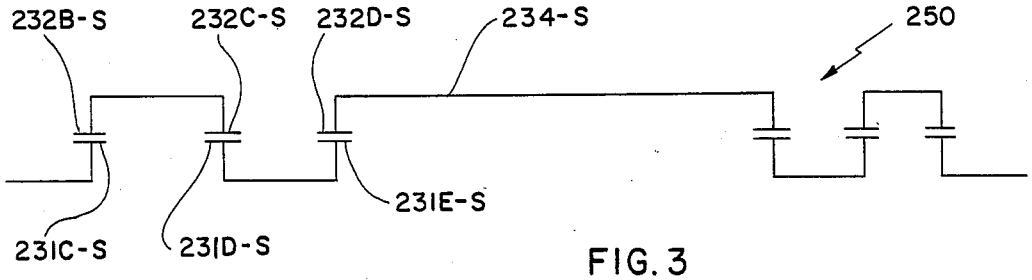
FIG. 3 is an electrical circuit diagram of part of the wrist band shown in FIG. 2.

FIG. 3 is a partial electrical schematic diagram of the unit shown in FIG. 2. Reference numerals in FIG. 3 correspond to reference numerals shown in FIG. 2; however, in FIG. 3 reference numerals are followed by a letter S. Pairs of corresponding plates 231 and 232 form capacitors. That is, plates 231C and 232B form one capacitor, for example. All capacitors are connected in series.

The opposite side of band 70, not shown, is connected to the opposite side of watch 20 in a similar manner. The schematic representation of the capacitive elements is shown generally as reference numeral 250.

In order to shorten band 70, a set of lugs, for example 235A and 236A, are cut off, along with plate 232A and part of plate 231B and a portion of dielectric strip 201. This eliminates one capacitor from the series of capacitors. The tuned frequency of the unit is given by the formula:

$$f = \frac{1}{2\pi\sqrt{LC}}$$

The value of antenna capacitance is determined by the size of plates, by the overall length and shape of band 70 and by the dielectric constant and thickness of insulating material 71. Capacitance of elements 231 and 232 is chosen to resonate the antenna of the receiver 20 at the desired frequency.

Cutting or severing the length of band 70 along a line between plastic strips 235 and 236 decreases the inductance, L. Removing series capacitors increases the overall capacitance, C, of the unit. Thus, shortening the unit decreases inductance and increases capacitance, keeping the tuned frequency, f, constant.

FIG. 4 shows an alternate embodiment of band 70 connected to watch 20. In this embodiment, capacitance plates 235 are thick enough to allow for a hole 402 formed therein. A U-shaped pin 401 is provided to fit into a hole 404 in watch 20 and watchband hole 402, thereby connecting watch 20 to band 70. A plurality of suitably spaced watchband holes 406, 408 is provided so that ever shorter watchband lengths can be connected to watch 20 by means of pin 401.

FIG. 5 depicts an alternate embodiment of the invention which eliminates separate capacitor plates. This embodiment has a center capacitor plate 501 and a U-shaped capacitor 502 with arms 502A and 502B. Plate 501 has layers of dielectric material 504A and 504B disposed thereon to separate it physically and isolate it electrically from the arms 502A and 502B of U-shaped capacitor 502. Plate 501 is held in position relative to capacitor 502 by pins 510 inserted in holes 512. Moving plate 501 further inside U-shaped capacitor 502 increases capacitance.

Another alternate embodiment is shown in FIG. 6. In this embodiment the insulating material 603A and 603B separates electrically conductive capacitor plates 602A and 602B. This results in an equivalent circuit such as that shown in FIG. 7. If needed this embodiment can result in a higher capacitance.

Referring now also to FIGS. **8*a*–8*c*** there are shown three alternate embodiment configurations of watchband conductors. Many other embodiments can be proposed that will accomplish the common function of maintaining a constant antenna tuning frequency notwithstanding changes in antenna watch band length.

Watchband 160 (FIG. **8*a*) has a nonconductive substrate 162 of thermoplastic rubber, leather or some other suitable material. On both major surfaces of substrate 160 is disposed copper, beryllium copper alloy or some other suitable electrically conductive material 164 in an elongated trapezoidal shape. The electrically conductive material 164 has the same shape on both sides of substrate 160; and both sides of substrate 160 are aligned so that the conductor trapezoidal shape on one side of substrate 160 has a one-to-one correspondence with the shape on the other side of substrate 160. The ends of watchband 160 and the extremities of conductive shape 164 can be cut so as to shorten band 160**, and increase relative overall capacitance, thereby maintaining the same electrical antenna tuning frequency characteristics as prevailed before cutting.

Similarly, in an alternate embodiment, watchband 166 (FIG. **8*b*) has a dielectric substrate 168. On both major surfaces is disposed an electrically conductive material 169** in an elongated parallelogram shape.

In yet another alternate embodiment of the present invention, watchband 170 (FIG. **8*c*) also has a dielectric substrate 172, on both major surfaces of which is disposed electrically conductive material 174 in a rectangular shape in which rectangular windows 176*a*–176*e* having varying widths, shown in phantom, are cut. When watchband 170 is cut from its extreme rightmost end, windows 176*a*–176*e*** are removed to ensure a constant antenna tuning frequency of the structure.

Alternatively, structure 174 may be electrically nonconductive while electrically conductive pads **176*a*–176*e***, connected to one another in series, are provided to accomplish the same function of maintaining constant antenna tuning frequency.

Other antenna configurations may be used without departing from the scope of the present invention. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A radio receiver comprising, in combination:

a dielectric strip which forms a portion of a wristband;

a plurality of capacitor plates disposed on both sides of said dielectric strip to form discrete capacitors, said capacitors being connected to one another in series;

to form a wristband loop antenna having predetermined inductance;

means connecting one end of said discrete capacitors to said radio receiver, the particular capacitor connected to said receiver being selectable;

whereby more discrete capacitors can be included in said wristband loop antenna to form a longer wristband with more inductance and less series capacitance, thereby no changing the tuned frequency of said antenna.

2. An adjustable length band structure having an antenna embedded therein comprising:

(a) a flexible, longitudinal, electrically non-conducting base having an upper major surface and a lower major surface;

(b) a first plurality of spaced apart, electrically conductive pads disposed on the upper surface of said base; and (c) a second plurality of spaced apart, electrically conductive pads disposed on the lower surface of said base in operative relationship to said first plurality of pads and correspondingly offset therefrom, so that at least one of said first plurality of pads overlaps a portion of two corresponding pads in said second plurality of pads and at least one of said second plurality of pads overlaps a portion of two corresponding pads in said first plurality of pads, forming an antenna with a predetermined tuning frequency.

3. The adjustable length band structure in accordance with claim 2, further comprising:

(d) a first electrically non-conducting shell associated with each of said first plurality of pads and adapted to mount thereon in order to cover said pads.

4. The adjustable length band structure in accordance with claim 2 wherein the length of said band can be shortened by removing one of said first plurality of pads and corresponding overlapped portions of two of said second plurality of pads, said pad removals having substantially no effect on said antenna tuning frequency.

5. In an adjustable length longitudinal watchband comprising a dielectric substrate having an upper major surface and a lower major surface, an antenna having a predetermined tuning frequency comprising:

(a) upper electrical conductive means disposed on the upper major surface of said substrate and forming one capacitor plate; and (b) lower electrical conductive means disposed on the lower major surface of said substrate and forming another capacitor plate.

6. The antenna having a predetermined tuning frequency in accordance with claim 5 wherein a portion of said watchband can be removed without affecting said predetermined antenna tuning frequency of the remaining watchband portion.

7. The antenna having a predetermined tuning frequency in accordance with claim 6 wherein said electrical conductive means have uniform cross sections along the length of said watchband.

8. The antenna having a predetermined tuning frequency in accordance with claim 6 wherein said electrical conductive means have non-uniform cross sections along the length of said watchband.

9. The antenna having a predetermined tuning frequency in accordance with claim 6 wherein said electrical conductive means are disposed on said substrate forming a predetermined shape so that said predetermined tuning frequency is unaffected by removing any portion of said watchband.

10. In a watchband comprising a dielectric substrate having an upper major surface and a lower major surface, a loop antenna having a predetermined inductance and tuning frequency, the improvement comprising a trapezoidally shaped electrical conductor disposed on the upper major surface of said dielectric substrate to form a first capacitor plate and an identically shaped electrical conductor disposed on the lower major surface of said dielectric substrate in one-to-one correspondence with said first capacitor plate.

11. In a watchband comprising a dielectric substrate having an upper major surface and a lower major surface, a loop antenna having a predetermined inductance and tuning frequency, the improvement comprising a parallelogram shaped electrical conductor disposed on the upper major surface of said dielectric substrate to form a first capacitor plate and an identically shaped electrical conductor disposed on the lower major surface of said dielectric substrate in one-to-one correspondence with said first capacitor plate.

12. In a watchband comprising a dielectric substrate having an upper major surface and a lower major surface, a loop antenna having a predetermined inductance and tuning frequency, the improvement comprising an electrical conductor having a plurality of windows, said electrical conductor being disposed on the upper major surface of said dielectric substrate to form a first capacitor plate and an identically shaped electrical conductor having a plurality of windows, said identically shaped electrical conductor being disposed on the lower major surface said first capacitor plate.

* * * * *